US006234145B1

(12) United States Patent
Shomura

(10) Patent No.: US 6,234,145 B1
(45) Date of Patent: May 22, 2001

(54) ENGINE CONTROL DEVICE

(75) Inventor: Nobuyuki Shomura, Hamamatsu (JP)

(73) Assignee: Suzuki Motor Corporation, Shizuoka-Ken (JP)

( * ) Notice: Subject to any disclaimer, the term of this patent is extended or adjusted under 35 U.S.C. 154(b) by 0 days.

(21) Appl. No.: 09/590,157

(22) Filed: Jun. 8, 2000

(30) Foreign Application Priority Data

Jun. 9, 1999 (JP) ..... 11-163046

(51) Int. Cl.[7] ..... F02P 5/00
(52) U.S. Cl. ..... 123/406.24; 123/406.25
(58) Field of Search ..... 123/406.24, 406.25, 123/478, 480; 701/111

(56) References Cited

U.S. PATENT DOCUMENTS 5,027,771 7/1991 Daikoku et al. .
6,024,070 * 2/2000 May et al. ..... 123/406.25
6,155,230 * 12/2000 Iwano et al. ..... 123/406.24
6,155,232 * 12/2000 Shibagaki ..... 123/406.24

* cited by examiner

*Primary Examiner*—John Kwon
(74) *Attorney, Agent, or Firm*—Darby & Darby

(57) ABSTRACT

In the engine control device, a reference crank angle and the rotational angle of the crank is detected. Based on the rotational frequency of the crank, which has been determined from the detected rotational angle of the crank, time from the reference crank angle to the target crank angle is estimated. Variations in the crank rotation are detected and stored. Based on the stored rotational variations, the periodicity of the rotational variations is detected. Based on the periodicity of the rotational variations, the estimated time from the reference crank angle to the target crank angle is corrected. Based on the thus obtained corrected time, an engine control signal corresponding to the target crank angle is output.

12 Claims, 8 Drawing Sheets

ENGINE CONTROL DEVICE

BACKGROUND OF THE INVENTION

1. Field of the Invention

The present invention relates to an engine control device for use in an internal combustion engine for performing a variety of controls such as ignition timing control, fuel injection timing control, etc., based on reference crank angles.

2. Description of the Prior Art

In an internal combustion engine, when the ignition timing is advanced or retarded or the fuel injection timing is advanced or retarded based on reference crank angles, it is usual to use a method of controlling by performing a predictive computation of the time required for reaching the target angle from the reference crank position based on the engine's rotational period. However, this method involves the following difficulties.

In the aforementioned method of performing predictive computation based on the rotational period, since the time from the latest reference crank angle signal to the necessary timing (e.g., the target ignition timing) is estimated based on the engine's rotational frequency (the time of one revolution) between the reference crank angle signal prior to the necessary timing and the reference crank angle signal one revolution before the former, the estimated value will be unstable with respect to the rotational variations (rotational changes) of the crankshaft.

In multi-cylinder engines, rotational variations occur due to combustion variations depending upon individual cylinders, which are attributed to intake amount scatter, the scatter in the sprayed amount of injected fuel, variation in the injector characteristics dependent on individual cylinders, variation in the carburetor characteristics dependent on individual cylinders. In particular, in the very low speed range in which lower amounts of fuel and intake air are used, the ratios of the above variations in the required amount of fuel and the amount of intake air become large and the rotational inertia is low, so that a slightest fluctuation in combustion for each cylinder may significantly affect the variations in rotation.

In a typical case where predictive computation is performed based on the rotational period of one revolution, for a four cycle engine, the period of one revolution (FIG. 1) for determining the target angle is affected by the combustion of other cylinders, hence the precision of the predictive computation is low in the very low rotational range where combustion fluctuations dependent on individual cylinders are liable to occur as stated above.

In the above predictive computing method, #1 ignition timing is controlled on the premise that the average rotational frequency during the period between #3α and the previous #3α is approximately equal to the average rotational frequency during the period from #3α to the ignition timing, as is shown in FIG. 2, for example. In this case, the one revolution roughly corresponds to the combustion stroke of cylinder #3 and the compression and combustion strokes of cylinder #2. Since the average rotational frequency during this interval is used to estimate the average rotational frequency for the compression stroke of cylinder #1, the estimate naturally presents poor precision if there are variations in combustion dependent on individual cylinders.

SUMMARY OF THE INVENTION

The present invention has been devised in view of the above difficulties, and it is therefore an object of the present invention to provide an engine control device which is capable of performing engine control aiming at a target crank angle with high accuracy by detecting the periodicity of the variations in rotation of an internal combustion engine and estimating the variations in rotation.

In order to achieve the above object, the present invention is configured as follows:

In accordance with the first aspect of the present invention, an engine control device includes:

- a means for detecting crank angles;
- a means for estimating the time required from a reference crank angle to a target crank angle based on the crank rotational frequency determined based on the detected crank angles;
- a means for detecting crank rotational variations based on the signal inputs of crank angles;
- a means for storing the rotational variations;
- a means for detecting the periodicity of the rotational variations based on the stored rotational variations;
- a means for correcting the estimated time from the reference crank angle to the target crank angle, based on the periodicity of the rotational variations; and
- a means for outputting an engine control signal corresponding to the target crank angle based on the corrected time.

In accordance with the second aspect of the present invention, the engine control device having the above first feature is characterized in that the crank angle detecting means detects the rotational variations dependent on each cylinder.

In accordance with the third aspect of the present invention, the engine control device having the above first feature is characterized in that the estimation of the time is computed using the simple or weighted average of a multiple number of computed values.

In accordance with the fourth aspect of the present invention, the engine control device having the above second feature is characterized in that the estimation of the time is computed using the simple or weighted average of a multiple number of computed values.

In accordance with the fifth aspect of the present invention, the engine control device having the above first feature is characterized in that the estimated value or the control value is modified in accordance with the degree of advancement of the target crank angle.

In accordance with the sixth aspect of the present invention, the engine control device having the above second feature is characterized in that the estimated value or the control value is modified in accordance with the degree of advancement of the target crank angle.

In accordance with the seventh aspect of the present invention, the engine control device having the above first feature is characterized in that correction of the estimated time is made in a predetermined low rotational frequency range and will not be made in middle and high rotational frequency ranges, and engine control based on the rotational frequency is switched in accordance with a predetermined hysteretic scheme of rotational frequency.

In accordance with the eighth aspect of the present invention, the engine control device having the above second feature is characterized in that correction of the estimated time is made in a predetermined low rotational frequency range and will not be made in middle and high rotational frequency ranges, and engine control based on the rotational frequency is switched in accordance with a predetermined hysteretic scheme of rotational frequency.

In accordance with the ninth aspect of the present invention, the engine control device having the above third feature is characterized in that correction of the estimated time is made in a predetermined low rotational frequency range and will not be made in middle and high rotational frequency ranges, and engine control based on the rotational frequency is switched in accordance with a predetermined hysteretic scheme of rotational frequency.

In accordance with the tenth aspect of the present invention, the engine control device having the above fourth feature is characterized in that correction of the estimated time is made in a predetermined low rotational frequency range and will not be made in middle and high rotational frequency ranges, and engine control based on the rotational frequency is switched in accordance with a predetermined hysteretic scheme of rotational frequency.

In accordance with the eleventh aspect of the present invention, the engine control device having the above fifth feature is characterized in that correction of the estimated time is made in a predetermined low rotational frequency range and will not be made in middle and high rotational frequency ranges, and engine control based on the rotational frequency is switched in accordance with a predetermined hysteretic scheme of rotational frequency.

In accordance with the twelfth aspect of the present invention, the engine control device having the above sixth feature is characterized in that correction of the estimated time is made in a predetermined low rotational frequency range and will not be made in middle and high rotational frequency ranges, and engine control based on the rotational frequency is switched in accordance with a predetermined hysteretic scheme of rotational frequency.

According to the first and second features of the invention, crank angle control such as ignition timing control, injection angle control and the like can be performed with good precision. Since the rotational variations can be detected at intervals between signals from the crank angle detecting means, it is possible to achieve accurate crank angle control based on fewer reference angle signals.

According to the third and fourth features of the invention, the precision of crank angle control is increased by putting the greatest weight on the rotational variation detection value corresponding to the previous cycle of the same cylinder. At the same time, if computed values (the average rotational frequency in each section and rotational frequency difference between two adjacent sections) fluctuate due to incidental load variations, the averaging can provide the required precision.

The conventional time (period measuring) control is performed based on the assumption that the engine rotates at a constant speed after the reference angle. In contrast, according to the fifth and sixth features of the invention, the estimated value is corrected in the sections where the actual rotational frequency tends to lower so as to improve the precision.

According to the seventh through twelfth features of the invention, it is possible to provide the required precision throughout the whole rotational frequency range with an inexpensive processor of a lower processing capability. It is also possible to realize smooth mode transitions without causing frequent transitions between the control modes, around the mode-transitional, rotational frequency.

DESCRIPTION OF THE PREFERRED EMBODIMENTS

The embodiments of the present invention will hereinafter be described in detail with reference to the accompanying drawings.

A cylinder determining device of this embodiment is used in a four-cycle three cylinder engine (internal combustion engine) and detects a reference angle based on the signal from a crank angle detector 10 of the crankshaft and also detects the periodicity of the rotational variations so as to predict the rotational variations to thereby perform engine control aiming at the target crank angle with precision.

Figure 1:
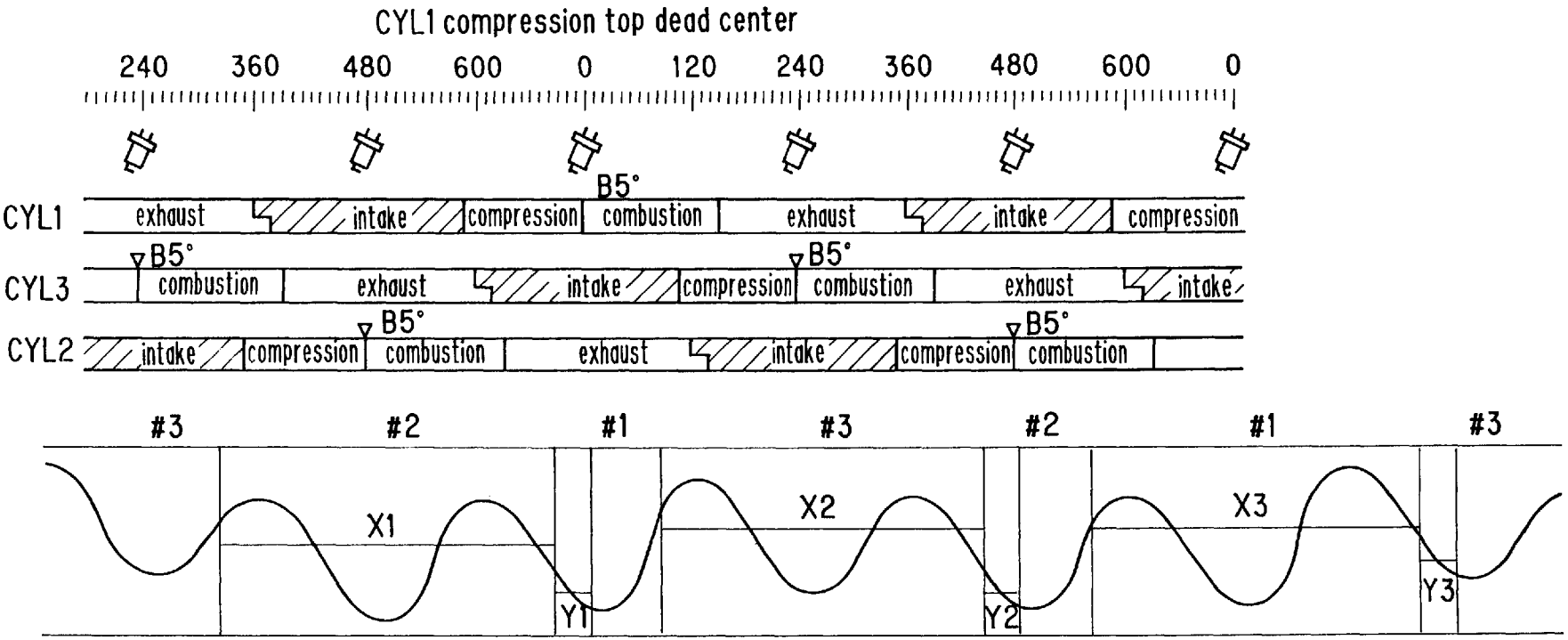
FIG. 1 is a timing chart showing a four-cycle three cylinder engine in accordance with the first embodiment.
Figure 2:
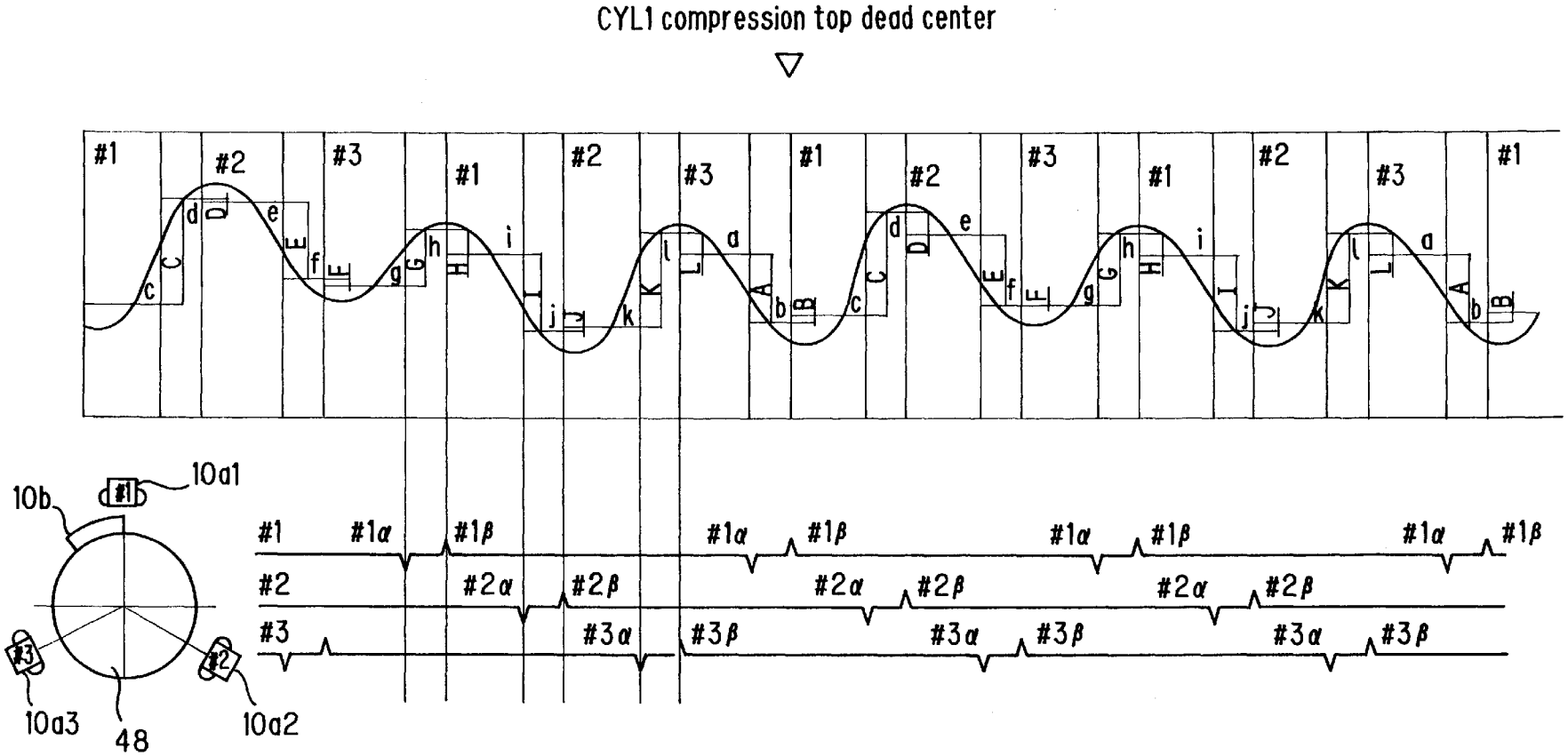
FIG. 2 is a diagram showing an example of the waveform of the rotational variations in relation to crank angle detectors of the engine corresponding to FIG. 1.

FIG. 1 is a timing chart showing a four-cycle three cylinder engine in accordance with the first embodiment and FIG. 2 is a diagram showing an example of the waveform of the rotational variations in relation to crank angle detectors of the same engine. FIGS. 3 through 7 are flowcharts showing the procedures of computing the target ignition timing based on the periodicity of the rotational variations. FIG. 8 is a block diagram showing the entire control system of the engine, which is common to all embodiments herein (the first and second embodiments).

As shown in FIG. 8, this control system includes a variety of detectors (sensors), specifically, a crank angle detector (engine speed detector) 10, a throttle opening detector 12, a pressure detector 14, an atmospheric pressure detector 16, an intake temperature detector 18, an engine temperature detector (cooling water temperature detector) 20 and an engine tilt angle detector 22, as required. Of these, at least the signals from crank angle detector 10 and engine temperature detector 20 are input to a processing unit 24. This processing unit 24 engages a general purpose or custom-made microcomputer unit and performs desired processes using appropriate software.

That is, processing unit 24 has a central processing unit (CPU) 28 which receives these signals by way of an input circuit (input interface) 26. This central processing unit 28 can exchange signals with an external communication unit via a communication interface 32. Central processor 28 incorporates a random access memory (RAM) and a read only memory (ROM), with separate memory 30 such as EEPROM (electrically erasable/programmable ROM), etc.

Central processor 28 outputs actuating signals via an output circuit 33 to an injector 34, an air amount adjusting actuator 36, various indicators 38, a fuel pump 40 and an ignition coil 42. Here, a spark signal is output via an igniter 44 and a power source unit 46 to ignition coil 42 so as to perform control of advancing or retarding the ignition timing.

Crank angle detector 10 shown in FIG. 2 includes three detection sensors 10*a*1, 10*a*2 and 10*a*3 located correspondingly at the preset crank angles (of the three cylinders). A rotor 48 provided for detection has a single trigger pole 10*b* between the first and second reference angles. Each of these detection sensors 10*a*1, 10*a*2 and 10*a*3 for different cylinders produces a signal representing the compression stroke and the exhaust stroke one revolution after the compression. This is the arrangement of the present embodiment.

Accordingly, crank angle sensors 10*a*1, 10*a*2 and 10*a*3 are arranged so as to oppose trigger pole 10*b*, at preset individual crank angles, and the signals from the sensors are input to the processing unit. Other arrangements may be permitted as long as the crank angle signals from individual cylinders can be obtained. In the first embodiment shown in FIG. 2, each cylinder has its own crank angle sensor (10*a*1, 10*a*2 or 10*a*3) as stated above so that each cylinder can independently detect signal β (BTDC5°:5° before top dead center) corresponding to the ignition timing at the start of operation and signal α (BTDC45°:45° before top dead center) for the reference signal for advance control. Signal α arises the moment the sensor comes close to the trigger pole and signal β is a triggering pulse arising the moment the sensor leaves the trigger pole.

FIGS. 1 and 2 are examples of the timing charts of the rotational variations during low rotational frequency operation of the four-cycle three cylinder engine. As shown in these charts, during the low rotational frequency range where the inertial force is low, the speed of rotation varies as it increases due to the combustion stroke of each cylinder and decreases due. to each compression stroke. Further, as stated concerning the prior art, variations dependent upon individual cylinders are liable to occur.

The present invention is to improve the accuracy of the time control from the reference crank angle to the target crank angle, notifying the facts that:

the same cylinder presents a stable combustion state with respect to that cylinder though the combustion state of each cylinder differs from that of others; and the characteristics of lowering of the speed of rotation due to a compression stroke and the load are almost the same, not depending upon the cylinders.

The timing charts shown in FIGS. 1 and 2 show the rotational variations wherein the combustion state of each cylinder differs from that of the others in the following order: the first cylinder>the second cylinder>the third cylinder. In other words, the first cylinder provides the best combustion and the third cylinder provides the worst combustion. In the charts, #1, #2 and #3 indicate the first, second and third cylinders, respectively and correspond to their ignition timings in the timing charts shown in FIGS. 1 and 2.

For example, in controlling the ignition timing, suppose that the ignition timing should be advanced from #1BTDC5° (5° before the top dead center of the first cylinder) shown in FIG. 1. In the conventional art system, the rotational frequency (period) of one revolution prior to the final reference angle before ignition is computed so as to estimate the time from the reference signal to the target ignition timing on the premise that the engine should rotate at the speed that has been computed even after the reference angle, whereby sparking is actuated after the passage of the settime. This method will not cause any problem in the middle and high rotational frequency ranges in which the inertial force is large enough and hence only little rotational variations occur, but presents poor accuracy in the low rotational frequency range where the rotational variations are large. In an engine having an odd number of cylinders, the average rotational frequency during one revolution will not coincide with the cycle of the rotational variations (for example, in a four-cycle three cylinder engine, two revolutions produce three cycles of increase in rotational speed, hence 1.5 cycles per revolution). Therefore, as shown in FIG. 1, the average rotational frequency X1 (X2, X3) during one revolution markedly differs from the average rotational frequency Y1 (Y2, Y3) from that point to the ignition. This naturally will cause the actual ignition timing to significantly deviate from the target ignition timing.

In contrast, in the first embodiment of the present invention, based on the time difference between two sequential signal inputs (#3β→#1α→#1β→#2α→#2β→#3α→#3β . . . ) and its corresponding angular signal (80°→40°→80°→40°→80°→ . . . ), the average rotational frequency is computed. This average value 'angle/time' for each section is designated by a, b, c, d, e, f, g, h, i, j, k and l in the chart shown in FIG. 2. Also, the differences in average rotational frequency between adjacent two sections between angles (designated by A=b−a, B, C, D, E, F, G, H, I, J, K and L) are computed. These rotational frequency differences have strong correlations with the following quantities.

A: rotational decrease due to the #1 cylinder's compression stroke and the load;

E: rotational decrease due to the #3 cylinder's compression stroke and the load; and I: rotational decrease due to the #2 cylinder's compression stroke and the load.

A, E and I are the amounts of rotational decrease due to compression and the load, so that there is little difference between them dependent upon the individual cylinders.

C: rotation increase due to #1 cylinder's combustion (the #1 cylinder's combustion state);

G: rotation increase due to #3 cylinder's combustion (the #3 cylinder's combustion state); and K: rotation increase due to #2 cylinder's combustion (the #2 cylinder's combustion state).

C, G and K depend on the combustion of each cylinder, so that these values are different dependent upon the individual cylinders.

From the above, prediction of the ignition timing of #1 can be carried out with a good precision in the following manner. That is, subtracted from the average rotational frequency 'a' between the latest reference angle signal (BTDC45°) before the ignition and the second latest reference angle signal (BTDC125°) is the rotation decrease A of the corresponding previous section, whereby the rotational frequency in the period from the latest reference signal to the target ignition timing will be estimated with a high accuracy.

The engine control in accordance with the first embodiment will be described with reference to the flowcharts shown in FIGS. 3 through 7. In this case, FIG. 3 is a flowchart showing the main routine, FIGS. 4 to 7 are flowcharts showing subroutines.

Figure 3:
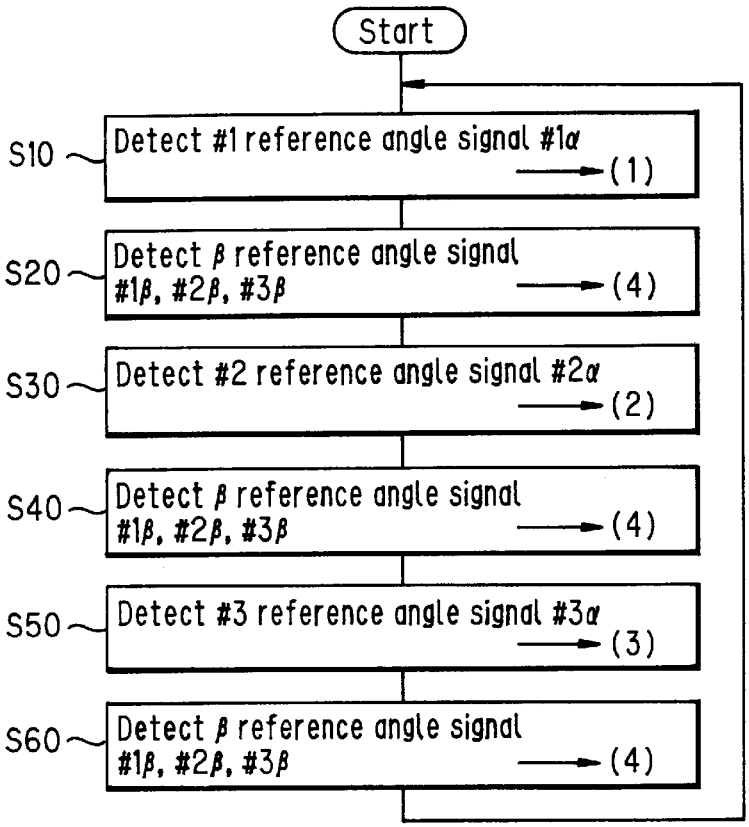
FIG. 3 is a flowchart showing a main routine of the procedure of computing the target ignition timing based on the periodicity of the rotational variations in accordance with the first embodiment.
Figure 4:
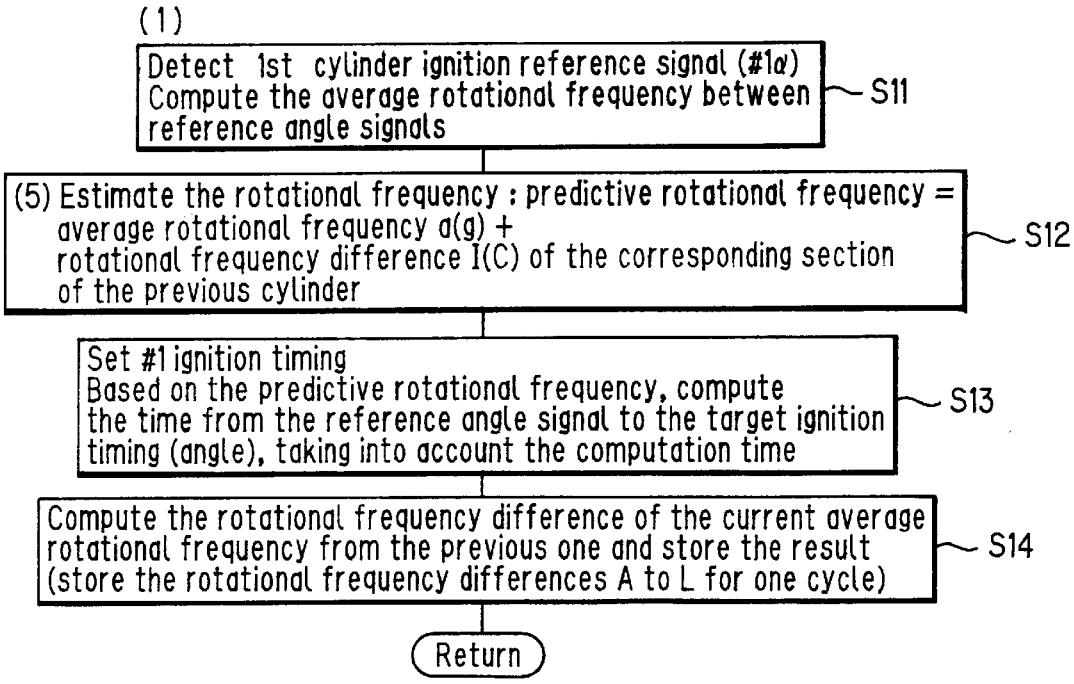
FIG. 4 is a flowchart (1) showing a subroutine.

In FIG. 3, as the program starts, first reference angle signal #1α of cylinder #1 is detected at Step S10, then the subroutine shown in FIG. 4 is executed.

Illustratively, in this subroutine, as the first cylinder ignition reference angle signal (#1α) is detected, the average rotational frequency between the reference angle signals is computed (S11). Based on this average rotational frequency, a predictive rotational frequency is computed. That is, 'predictive rotational frequency=average rotational frequency a(g)+rotational frequency difference I(C) as to the previous cylinder's corresponding section' is computed (S12). Based on this computation, the ignition timing of cylinder #1 is set. In this case, based on the predictive rotational frequency, time from the reference angle signal to the target ignition timing (angle) is computed. In one word, the time is set taking into account the computing time (S13). The rotational frequency difference of the current average rotational frequency from the previous one is computed and stored (the rotational frequency differences A to L for one cycle should be stored) (S14).

Figure 7:
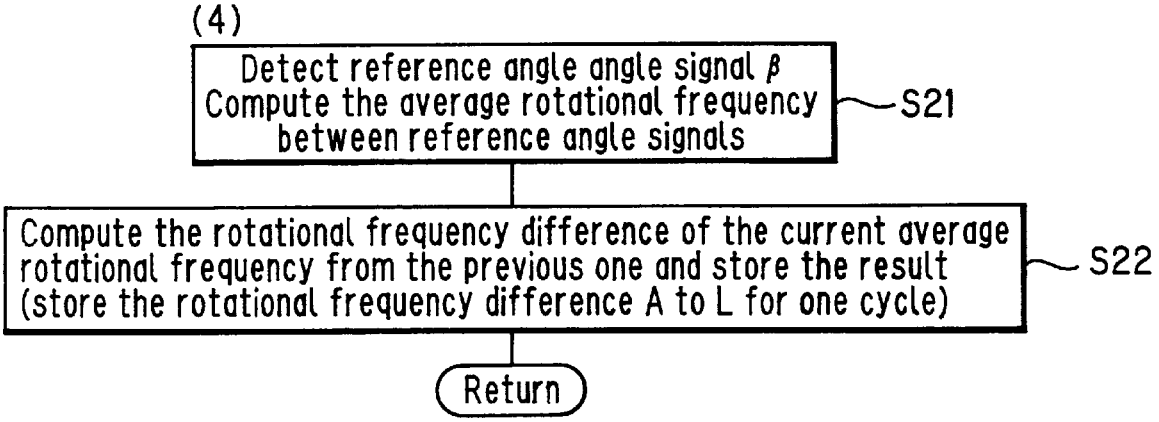
FIG. 7 is a flowchart (4) showing a subroutine.
Figure 8:
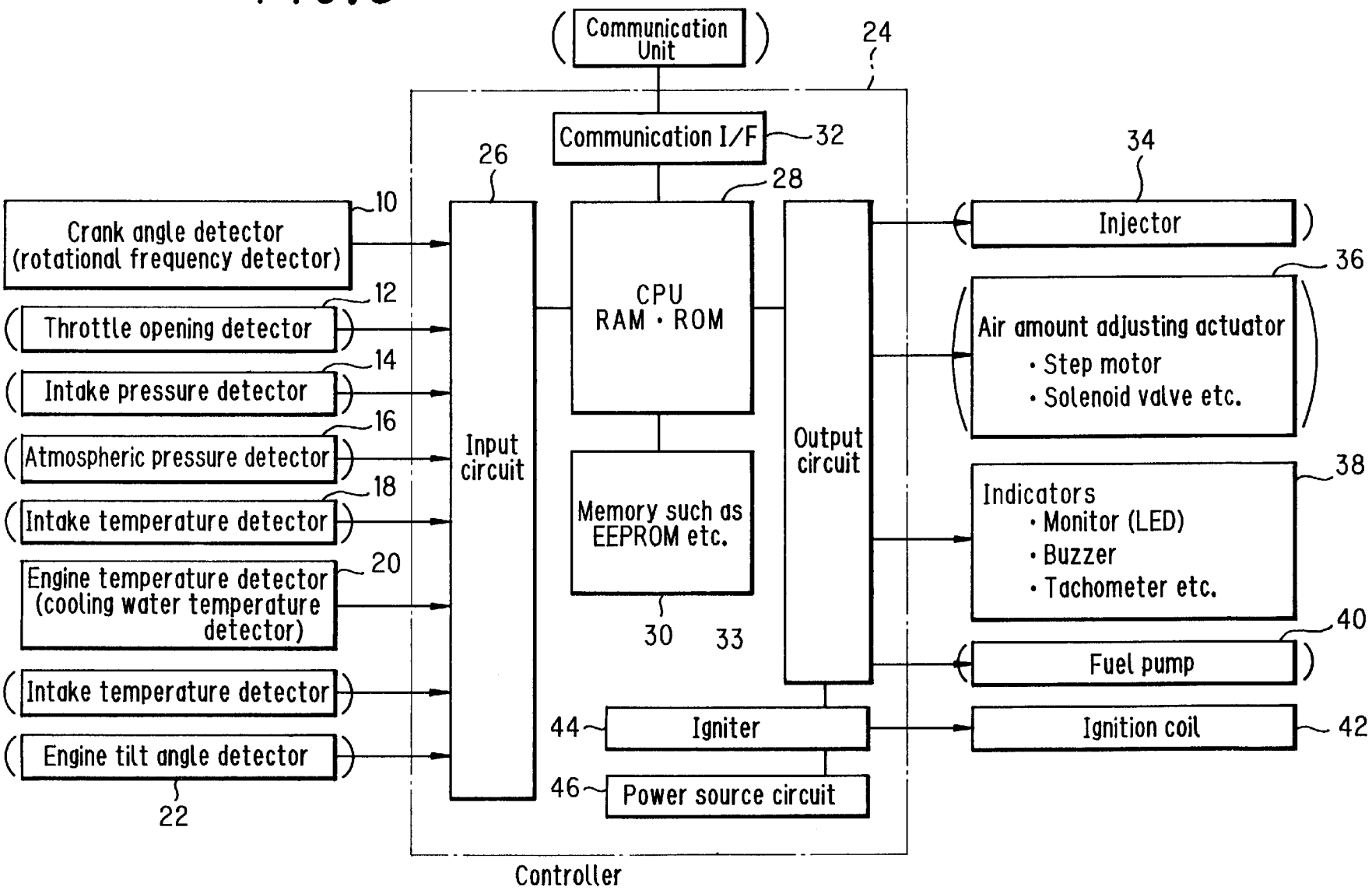
FIG. 8 is a block diagram showing the entire control system of an engine in accordance with the first and second embodiments.

Subsequently, in the main routine after S10, reference angle signal β(#1β, #2β and #3β) is detected and the subroutine shown in FIG. 7 is executed (S20). Illustratively, the average rotational frequency during the period from the previously detected reference angle signal is computed (S21) so as to calculate the rotational frequency difference of the current average rotational frequency from the previous one. This is stored (the rotational frequency differences A to L for one cycle should be stored) (S22).

Figure 5:
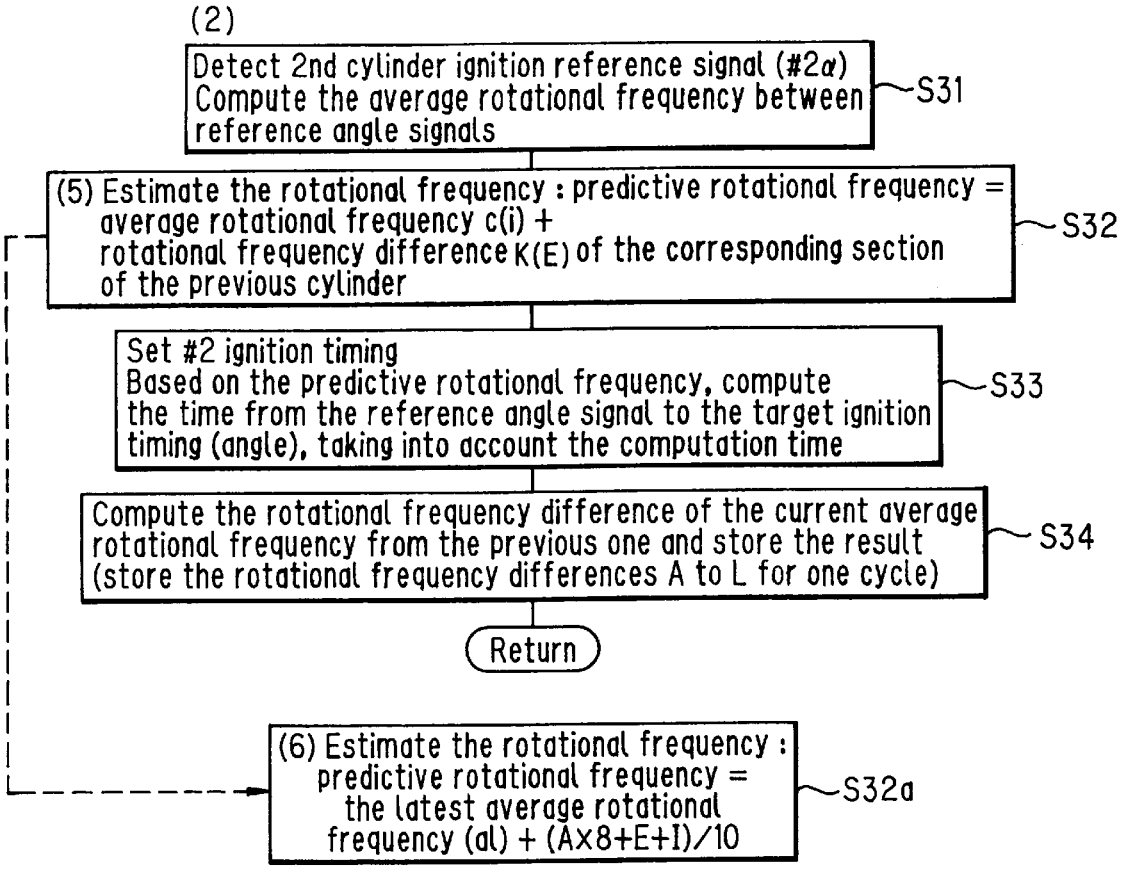
FIG. 5 is a flowchart (2) showing a subroutine.

Next, in the main routine after S20, reference angle signal #2α of cylinder #2 is detected at Step 30, and the subroutine shown in FIG. 5 is executed. Illustratively, as the second cylinder ignition reference angle signal (#2α) is detected, the average rotational frequency between the reference angle signals is calculated (S31). Based on this average rotational frequency, a predictive rotational frequency is computed. That is, 'predictive rotational frequency=average rotational frequency c(1)+rotational frequency difference K(E) as to the previous cylinder's corresponding section' is computed (S32). Based on this computation, the ignition timing of cylinder #2 is set. In this case, based on the predictive rotational frequency, time from the reference angle signal to the target ignition timing (angle) is computed. Or simply, the time is set taking into account the computing time (S33). The rotational frequency difference of the current average rotational frequency from the previous one is computed and stored (the rotational frequency differences A to L for one cycle should be stored) (s34).

Instead of the above step S32, the procedure of S32*a* shown in FIG. 5 may be effected so as to attain an improved accuracy. That is, 'predictive rotational frequency=the latest average rotational frequency (a1)+(A×8+E+I)/10' is computed (S32*a*). This case, however, needs increased storage capacity for rotational frequency differences (for one cycle) and increased computation time.

Then, in the main routine after S30, reference angle signal β(#1β, #2β and #3β) is detected in the same manner as S20 and the subroutine shown in FIG. 7 is executed (S40).

Figure 6:
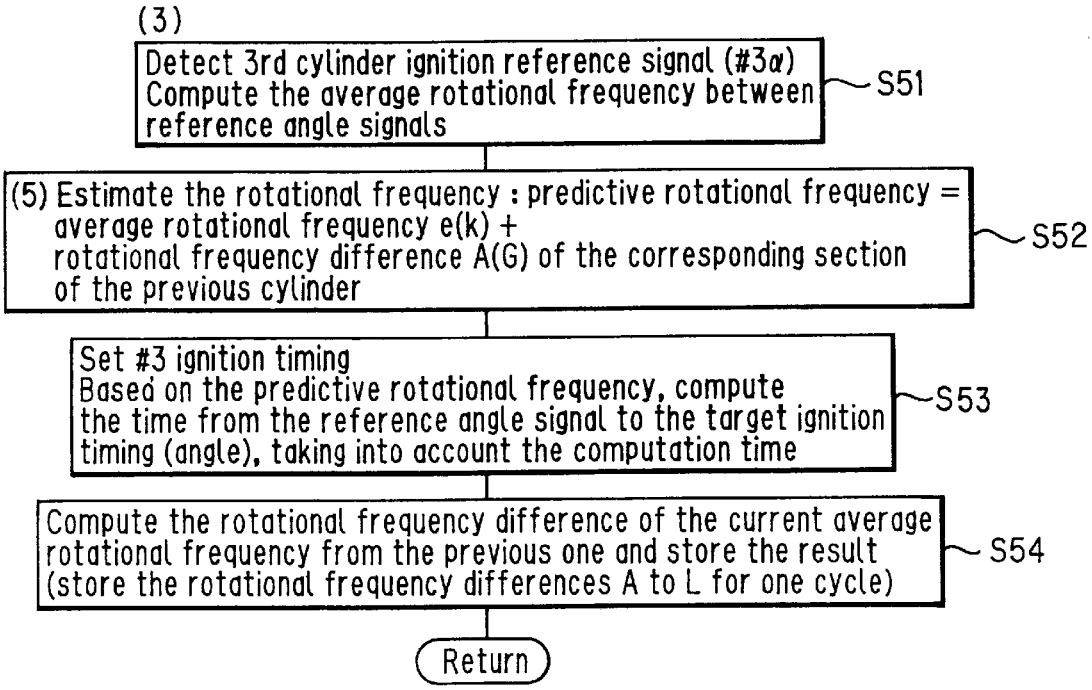
FIG. 6 is a flowchart (3) showing a subroutine.

Next, reference angle signal #3α of cylinder #3 is detected (S50), and the subroutine shown in FIG. 6 is executed. Illustratively, as the third cylinder ignition reference angle signal (#3α) is detected, the average rotational frequency between the reference angle signals is calculated (S51). Based on this average rotational frequency, a predictive rotational frequency is computed. That is, 'predictive rotational frequency=average rotational frequency e(k)+rotational frequency difference A(G) as to the previous cylinder's corresponding section' is computed (S52). Based on this computation, the ignition timing of cylinder #3 is set. In this case, based on the predictive rotational frequency, time from the reference angle signal to the target ignition timing (angle) is computed. Or, simply, the time is set taking into account the computing time (S53). The rotational frequency difference of the current average rotational frequency from the previous one is computed and stored (the rotational frequency differences A to L for one cycle should be stored) (S54).

Then, in the main routine after S50, reference angle signal β(#1β, #2β and #3β) is detected in the same manner as S20. After the execution of the subroutine (S60)shown in FIG. 7, the operation returns to the start of the main routine.

In the above configuration, since the rotational decreases A, E and I of the different cylinders have small differences therebetween, I may be used instead of A when effecting the above engine control.

Further, taking into consideration the possibility of the precision being degraded due to occurrence of fluctuations in A, E and I caused by incidental load variations, the simple average or weighted average of A, E and I may be used. For example, (A×8+E+I)/10 for #1, (E×8+I+A)/10 for #3 and (I×8+A+E)/10 for #2 can be used. Since each cylinder presents stable rotational variations for every cycle even though combustion characteristics are different depending upon the individual cylinders, the greatest weight is assigned to the previous rotational variation of the same cylinder in the corresponding section.

If the system has high enough storage capacity and processing capability, it is also possible to take into account the second to last rotational variation.

Next, a method for further improving the precision of the engine control of the first embodiment will be described.

The above engine control is effected based on the assumption that the engine rotates at a uniform speed from the latest reference angle to the target ignition timing. In practice, however, the actual engine speed tends to decrease as shown in FIG. 1 in the section in question (between α and β during the compression stroke: in a four cycle engine, the compression stroke and exhaust stroke alternate in the same section between α and β, and since combustion comes after the compression stroke, an ignition after the exhaust stroke produces no effect.) Since this rotational decrease is attributed mainly to the compression stroke and the load, as stated above, the rotational decrease will produce little difference depending upon the cycles.

Therefore, as the target ignition timing is made to advance, the average rotational frequency during the period from the reference angle signal to the target ignition timing increases. This increase can be corrected so as to attain a more accurate control. For example, correcting rotational frequencies M to the predictive rotational frequency mentioned with reference to FIG. 4 and others may be introduced in relation to the degrees of the advance angle from the ignition timing at the start of operation, in a table form as shown in Table 1 below, and the predictive rotational frequency can be corrected by adding the associated correcting rotational frequency M.

TABLE 1

| | | | | | | | | |
|---|---|---|---|---|---|---|---|---|
| Degree of advance angle | Large | ... | ... | Medium | ... | ... | ... | 0 |
| Correcting rotational frequency M | Large | ... | ... | Medium | ... | ... | ... | 0 |

Predictive rotational frequency=a−A+M (Predictive rotational frequency=a1−(A×8+E+I)/10+M)

In order to further improved the precision, correcting rotational frequencies M may be determined depending upon the degree of the advance angle and the rotational frequency (or the load), as shown in Table 2. The load can be calculated based on the degree of throttle opening or the rotational frequency with respect to the depression at engine manifold. Alternatively, modification of the target crank angle etc., may also produce a similar effect.

TABLE 2

| | | Correcting rotational frequency M | | | | |
|---|---|---|---|---|---|---|
| | | Degree of advance angle | | | | |
| | | Large | . . . | . . . | Medium . . . . . | 0 |
| Rotational frequency | Large | M11 | M12 | M13 | | M1n |
| | . | M21 | | | | |
| | . | | | | | |
| | . | | | | | |
| Load | Small | Mn1 | | | | Mnn |

Figure 9:
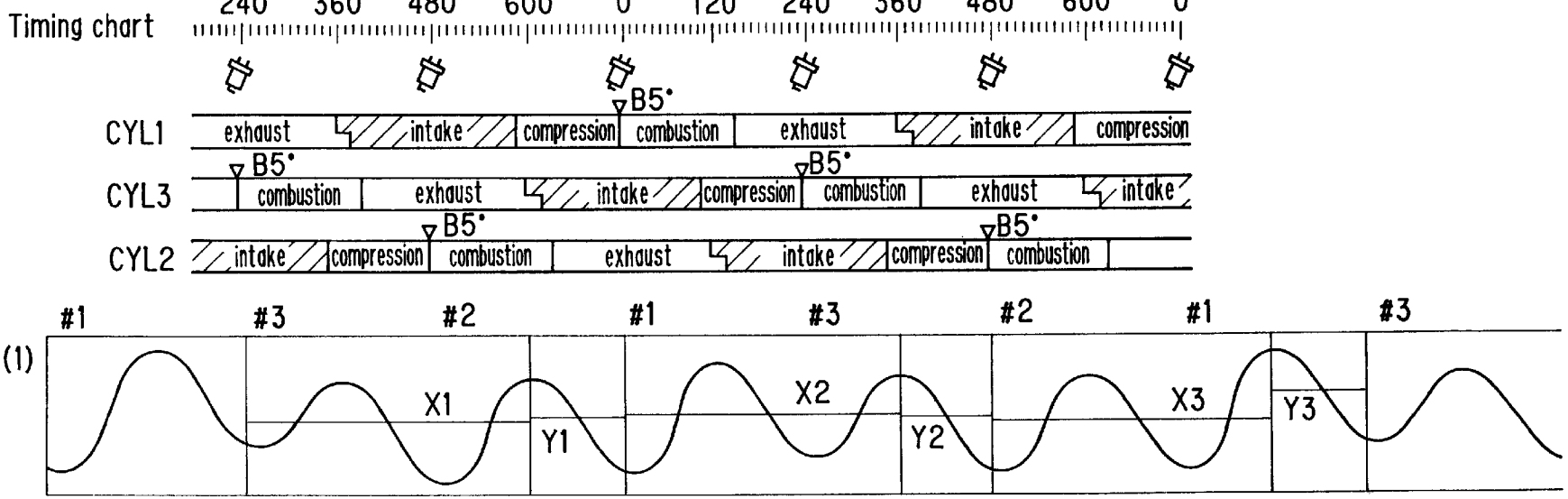
FIG. 9 is a timing chart showing a four-cycle three cylinder engine in accordance with the second embodiment.
Figure 10:
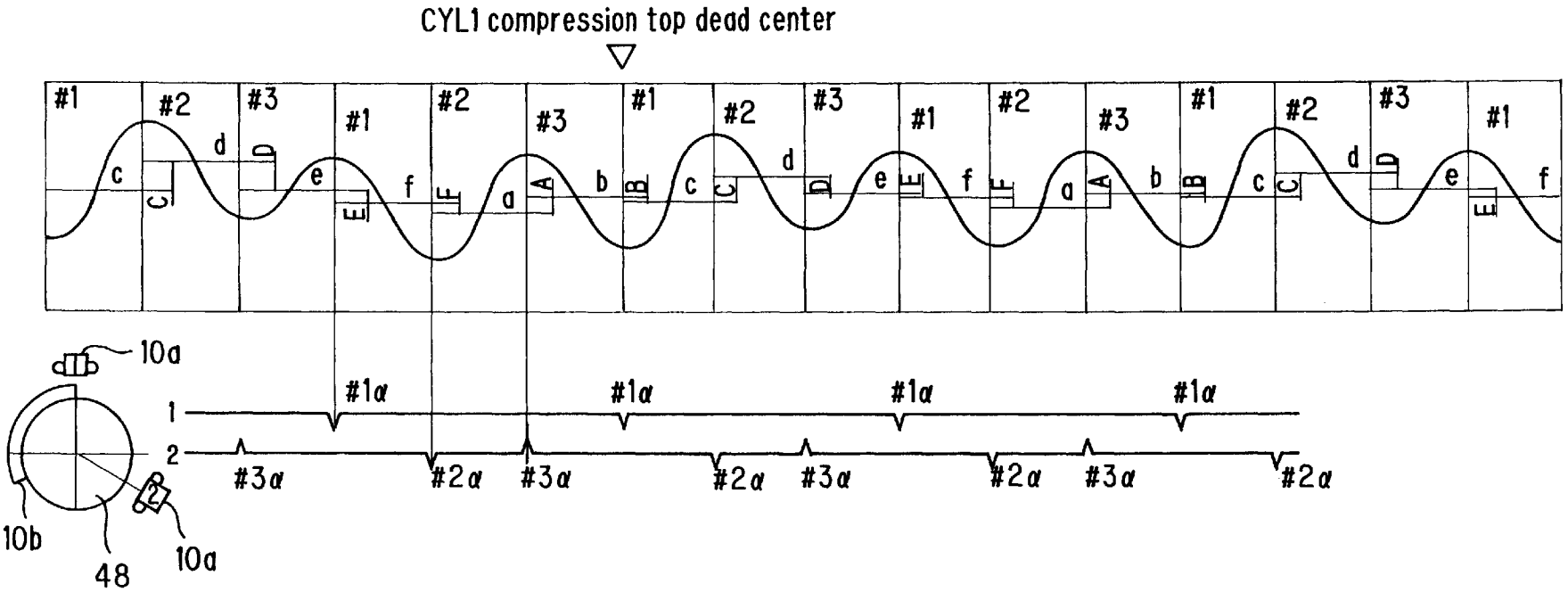
FIG. 10 is a diagram showing an example of the waveform of the rotational variations in relation to crank angle detectors of the engine corresponding to FIG. 9.

FIGS. 9 and 10 show the illustrative charts of the second embodiment of the present invention.

In the second embodiment, signals from crank angle sensors which are arranged opposing a trigger pole 10b at set crank angles (with intervals of 120°) are input to the engine control unit. The second embodiment shown in FIG. 9 includes a crank angle sensor 10*a*, another crank angle sensor 10*a* which generates positive and negative signals at the angles for ignition timings (e.g., BTDC5°) at the start of operation and a trigger pole 10*b*, so that reference angle signals are input at intervals of 120° to the engine control unit.

The system of the second embodiment uses a lower number of crank angle sensors and sensor input circuits compared to the crank angle system shown in FIG. 2. The method of improving the precision in this case is illustrated hereinbelow.

The timing charts shown in FIGS. 9 and 10 show the rotational variation of a four-cycle three cylinder engine running at a low engine speed, where the combustion state of each cylinder differs from that of others in the following order: the first cylinder>the second cylinder>the third cylinder. In other words, the first cylinder provides the best combustion and the third cylinder provides the worst combustion.

In the second embodiment, based on time difference between angle signal inputs, the average rotational frequency during the period for 120° between angle signals is computed (a, b, c, d, e and f in FIG. 10) and difference in average rotational frequency between two adjacent sections between angles (A=b−a, B, C, D, E, F) is computed.

The sections with average rotational frequencies b, d and f correspond to the rotational frequency decreased state due to compression and the load, and hence there is little difference between them dependent upon the individual cylinders. Therefore, the difference in rotation frequency between one of the sections and its previous section, i.e., A=b−a, C and E has a strong correlation with the following quantity.

A: rotation increase due to #2 cylinder's combustion (the #2 cylinder's combustion state);

C: rotation increase due to #1 cylinder's combustion (the #1 cylinder's combustion state); and E: rotation increase due to #3 cylinder's combustion (the #3 cylinder's combustion state).

Therefore, estimation of the ignition timing of #1 can be carried out with a good precision in the following manner. That is, added to the average rotational frequency 'a' between the latest reference angle signal (BTDC125°) immediately before the ignition and the second latest reference angle signal (BTDC245°) is the rotational variation A of the corresponding previous section, whereby the average rotational frequency from the latest reference crank angle signal to the target ignition timing can be estimated with a high accuracy (taking into account the combustion state of #2 and the rotational decrease due to compression of #1 and the load).

Further, taking into consideration the possibility of the precision being degraded due to occurrence of incidental load variations, the simple average or weighted average of A, C and E may be used. For example, (A×8+C+E)/10 for #1, (C×8+E+A)/10 for #3 and (E×8+A+C)/10 for #2 can be used.

Since the second embodiment performs the engine control using a lower number of reference crank angle inputs, this configuration needs a lower number of arithmetic operations with less memory capacity for storing the differences in rotation frequency. The signals are input at regular intervals (of an angle of 120°), so that the average rotational frequency can readily be computed. Hence this configuration can be realized by an inexpensive control processing device.

The present invention should not be limited only to ignition timing control as above, but can be applied to engine control (such as injection start angle control, injection stop angle control, etc.) which determines the target crank angle by computation based on time control (cycle measurement control) from the reference angle.

In the middle and high rotational frequency ranges where the inertial force is increased and the difference in combustion between cylinders becomes inconspicuous, it is possible to provide adequate precision based on the conventional scheme. Therefore, it is possible to provide a configuration in which engine control is switched from the mode of the present invention into the conventional mode with some hysteresis as the engine speed increases from the low rotational frequency range to the middle and high ranges.

For example, engine control may be switched into the conventional mode at 1500 rpm and may be switched at 1200 rpm when returning from the conventional mode into the control mode of the present invention. This configuration makes it possible to provide the required precision throughout the whole rotational frequency range with an inexpensive processor which does not have computation capability of the present invention, and realizes smooth mode transition without causing frequent transitions between the control modes even if the engine is operated around the mode transitional rotational frequency.

As has been described heretofore, according to the present invention, engine control aiming at the target crank angle can be performed with a good precision by detecting the periodicity of the rotational variations of the internal combustion engine and predicting the rotational variations.

What is claimed is:

1. An engine control device comprising:

a means for detecting crank angles;

a means for estimating the time required from a reference crank angle to a target crank angle based on the crank rotational frequency determined based on the detected crank angles;

a means for detecting crank rotational variations based on the signal inputs of crank angles;

a means for storing the rotational variations;

a means for detecting the periodicity of the rotational variations based on the stored rotational variations;

a means for correcting the estimated time from the reference crank angle to the target crank angle, based on the periodicity of the rotational variations; and a means for outputting an engine control signal corresponding to the target crank angle based on the corrected time.

2. The engine control device according to claim 1, wherein the crank angle detecting means detects the rotational variations dependent on each cylinder.

3. The engine control device according to claim 1, wherein the estimation of the time is computed using one of the simple and the weighted average of a multiple number of computed values.

4. The engine control device according to claim 2, wherein the estimation of the time is computed using one of the simple and the weighted average of a multiple number of computed values.

5. The engine control device according to claim 1, wherein one of the estimated value and the control value is modified in accordance with the degree of advancement of the target crank angle.

6. The engine control device according to claim 2, wherein one of the estimated value and the control value is modified in accordance with the degree of advancement of the target crank angle.

7. The engine control device according to claim 1, wherein correction of the estimated time is made in a predetermined low rotational frequency range and will not be made in middle and high rotational frequency ranges, and engine control based on the rotational frequency is switched in accordance with a predetermined hysteretic scheme of rotational frequency.

8. The engine control device according to claim 2, wherein correction of the estimated time is made in a predetermined low rotational frequency range and will not be made in middle and high rotational frequency ranges, and engine control based on the rotational frequency is switched in accordance with a predetermined hysteretic scheme of rotational frequency.

9. The engine control device according to claim 3, wherein correction of the estimated time is made in a predetermined low rotational frequency range and will not be made in middle and high rotational frequency ranges, and engine control based on the rotational frequency is switched in accordance with a predetermined hysteretic scheme of rotational frequency.

10. The engine control device according to claim 4, wherein correction of the estimated time is made in a predetermined low rotational frequency range and will not be made in middle and high rotational frequency ranges, and engine control based on the rotational frequency is switched in accordance with a predetermined hysteretic scheme of rotational frequency.

11. The engine control device according to claim 5, wherein correction of the estimated time is made in a predetermined low rotational frequency range and will not be made in middle and high rotational frequency ranges, and engine control based on the rotational frequency is switched in accordance with a predetermined hysteretic scheme of rotational frequency.

12. The engine control device according to claim 6, wherein correction of the estimated time is made in a predetermined low rotational frequency range and will not be made in middle and high rotational frequency ranges, and engine control based on the rotational frequency is switched in accordance with a predetermined hysteretic scheme of rotational frequency.

* * * * *